United States Patent [19]

DuBois, Jr.

[11] Patent Number: 4,720,652

[45] Date of Patent: Jan. 19, 1988

[54] SEALED BEAM HEADLAMP AND METHOD FOR TESTING ITS SERVICEABILITY

[75] Inventor: Richard DuBois, Jr., Caldwell, N.J.

[73] Assignee: Cooper Industries, Inc., Houston, Tex.

[21] Appl. No.: 4,470

[22] Filed: Jan. 20, 1987

[51] Int. Cl.[4] ..... H01K 1/28; H01K 1/50; H01J 9/42

[52] U.S. Cl. ..... 313/25; 313/113; 313/572; 313/579; 313/643; 445/3; 445/18

[58] Field of Search ..... 313/579, 113, 643, 572, 313/25; 445/3, 6, 18

[56] References Cited

U.S. PATENT DOCUMENTS

| | | | |
|---|---|---|---|
| 3,364,378 | 1/1968 | Beesley | 313/113 X |
| 3,418,512 | 12/1968 | T'Jampens et al. | 313/579 X |
| 4,302,697 | 11/1981 | Demas et al. | 313/578 X |
| 4,463,277 | 7/1984 | De Caro | 313/579 X |

FOREIGN PATENT DOCUMENTS

| | | | |
|---|---|---|---|
| 0121731 | 7/1984 | Japan | 445/3 |
| 0693468 | 10/1979 | U.S.S.R. | 445/3 |

*Primary Examiner*—Palmer C. DeMeo
*Attorney, Agent, or Firm*—E. E. Scott; A. R. Thiele

[57] ABSTRACT

A sealed beam lamp having an outer envelope defining a gas-tight enclosure filled with an inert nonreactive gas at a pressure in the range of 5 to 50 Torrs, and an illuminating burner capsule mounted within the enclosure. The integrity of the gas-tight enclosure as well as the pressure of the gas is verified by creating a predetermined electrical potential within the enclosure to form a glow discharge in the gas if the gas pressure is within a predetermined range indicating the lamp is serviceable and an arc discharge if the gas pressure is in excess of the range indicating the lamp is defective.

15 Claims, 2 Drawing Figures

SEALED BEAM HEADLAMP AND METHOD FOR TESTING ITS SERVICEABILITY

BACKGROUND OF THE INVENTION

1. Field of the Invention

This invention relates sealed beam lamps, typically used with motor vehicles, and a method for inspection of the sealed beam lamps after assembly.

2. Description of the Prior Art

The prior art discloses a variety of sealed beam lamp designs. U.S. Pat. Nos. 3,904,904, 3,917,939, and 4,339,685 all illustrate sealed beam headlight assemblies wherein a burner capsule or illuminating bulb is enclosed within an outer envelope. The outer envelope is filled with an inert gas to maintain a contaminant free environment. Experience has shown this arrangement effectively minimizes degradation of the various internal components of the lamp such as the highly reflective coating of the reflector and the internal bulb supporting structure. Usually, the inert gas in the envelope is charged to a pressure slightly below atmospheric pressure. The lamp shown in U.S. Pat. No. 3,904,904 is fairly typical of the art insofar as it shows the inert gas at a pressure of about 620 Torrs (62 cm of mercury column at 20° C.).

While sealed beam headlight arrangements such as the foregoing have proven to be satisfactory in most applications, heat generated in the burner capsule or illuminating bulb limits the service life of the sealed-beam lamp. Progressive deterioration of lamp components is caused by hot spots in the lens resulting from convection currents in the inert gas occurring during use of the lamp and contaminants leaking into the envelope. These problems are compounded by the difficulty of accurately verifying the integrity of the contaminent free environment within the envelope of the sealed beam lamp during manufacture.

There is, therefore, a need in the art to provide a sealed beam lamp which can be adequately cooled, is free of hot spots in the lens, and has a substantially reduced level of contaminants in the envelope.

In addition, there is also a need in the art to verify when such conditions have been achieved during lamp manufacture.

SUMMARY OF THE INVENTION

The sealed beam lamp of the present invention includes an outer envelope which defines a gas-tight enclosure filled with an inert or non-reactive gas. Mounted within the gas-tight enclosure is a burner capsule or illuminating blub. The burner capsule or illuminating bulb is mounted within the enclosure on a support arrangement which includes a pair of wires extending through the shell of the outer envelope into the gas-tight enclosure. The pair of wires is connected to the filament of the burner capsule or illuminating bulb to accomodate its energization and subsequent illumination.

The inert gas in the sealed beam lamp of the present invention is charged to a pressure of about 5 to 50 Torrs, measured at 20° C., or 1/100 to 1/10 of the pressure provided in arrangements heretofore in use. This level of pressurization provides for adequate cooling, and a reduction in convection currents in the inert gas. Such improvements allow plastics to be used for sealed beam lamps instead of the more commonly used and heavier glass.

To verify that sealed beam headlamps have internal inert gas pressures in the range of 5 to 50 Torrs, it has been found that a glow discharge will form in the pressurized inert gas when the probe of a Tesla coil operating at a predetermined potential is touched to the rim of the reflector.

When the internal inert gas is at a higher pressure than 5 to 50 Torrs due to the leakage of a contaminant into the envelope or improper filling of the enclosure during its assembly, an arc discharge rathern than a glow discharge will occur at the same potential of the Tesla coil. Thus, it becomes very easy to check if the internal inert gas in the lamp is at the correct pressure by mementarily charging the lamp with a Tesla coil and watching to see if a glow discharge or an arc discharge results. If an arc discharge occurs, the gas pressure in the lamp is too high and the lamp is defective.

DESCRIPTION OF THE DRAWINGS

A better understanding of the improved headlamp of the present invention may be had by reference to the drawings wherein.

DESCRIPTION OF THE PREFERRED EMBODIMENT

Figure 1:
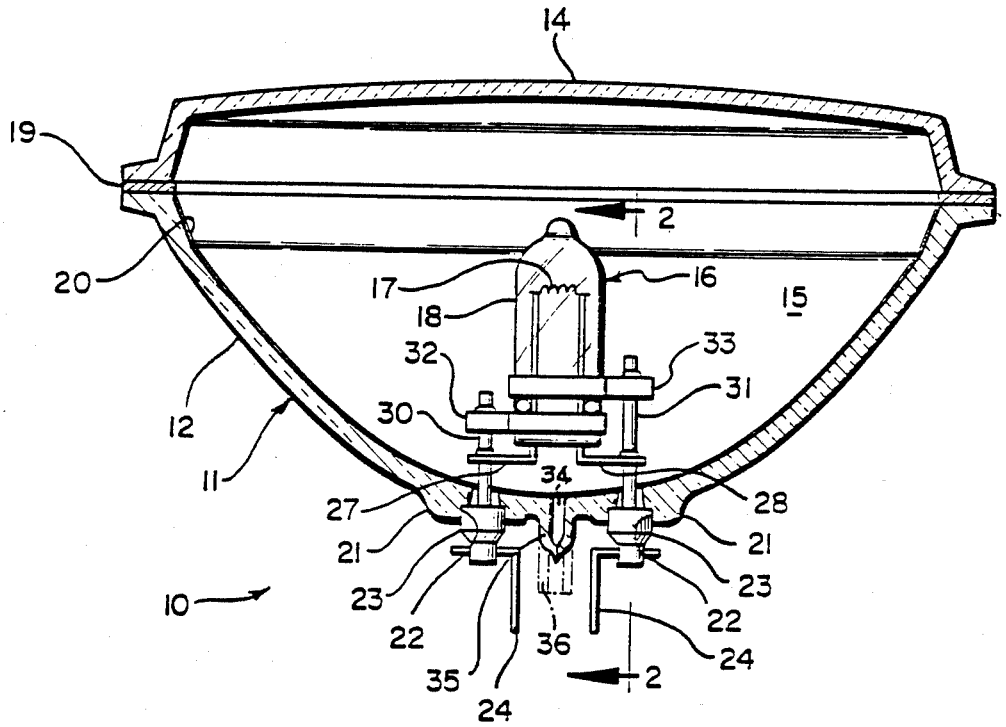
FIG. 1 is a sectional view of a vehicle headlamp embodying the invention.
Figure 2:
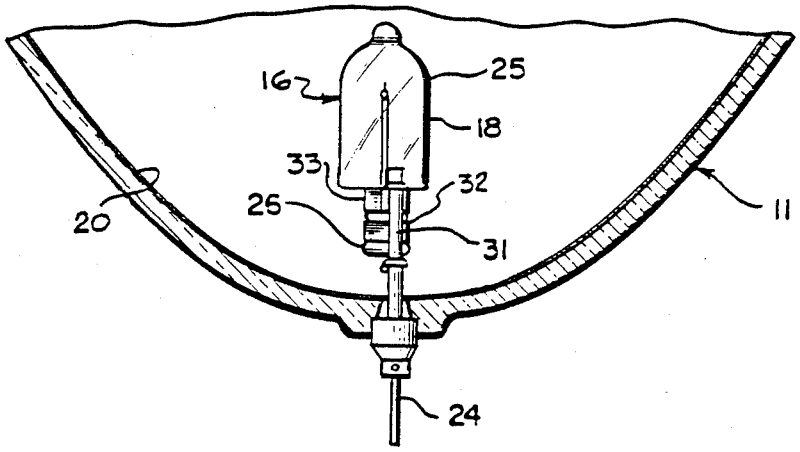
FIG. 2 is a cross-sectional view taken generally along line 2—2 in FIG. 1.

FIGS. 1 and 2 show a single filament sealed beam headlamp 10 embodying the invention, although it is to be understood that the invention also contemplates use in a multifilament headlamp as will be readily apparent from the following description. Headlamp 10 includes an envelope 11 having an outer shell formed into a parabolically-shaped reflector 12 and a lens 14. Reflector 12 and leans 14 define gas-tight enclosure 15.

Enclosure 15 is filled with an inert or nonreactive gas, and a tungsten-halogen type burner capsule or illumination bulb 16. As is well known in the art, burner 16 includes a tungsten filament 17 encapsulated in a glass bulb 18 filled with halogen gas. Reflector 12 and lens 14 can be formed of glass, plastic, or other suitable material and can be secured together to form a gas-tight seal about their mating peripheries by an inorganic sealant such as an epoxy adhesive 19. If desired reflector 12 and lens 14 may be hermetically secured together by other conventional means such as fusion sealing, mechanical fasteners or the like.

In the preferred embodiment, reflector 12 is formed of a mineral filled nylon material having a highly reflective aluminum coating 20 placed on its interior surface. Lens 14 is formed of relatively lightweight, durable, and easily handled clear polycarbonate plastic. In this regard, it should be noted that testing has shown that hot spots generally do not develop in lens 14 as was the case with many prior art arrangements. Additionally the headlamp design of the present invention has minimized the development of convection currents in the inert gas between the burner 16 and envelope 11. Consequently, lens 14 can be formed from the more durable yet generally less heat resistant plastics, such as the polycarbonate mentioned above.

As shown in the drawings, reflector 12 has a pair of bosses 21 integrally formed on its rear surface. Openings 22 extending through bosses 21. Ferrules 23 are secured to bosses 21 to cover openings 22. Terminals 24 are attached to ferrules 23 and are adapted to be connected to an electrical power supply for energizing and illuminating sealed beam lamp 10.

As discussed in detail in the Assignee's U.S. Pat. No. 4,363,994, bulb 18 is preferably formed of glass and includes a substantially cylindrical envelope portion 25 and a relatively flat pressed base portion 26. Lead wires 27 and 28 extend through base 26 to support tungsten filament 17 within bulb 25.

Burner 16 is supported within envelope 11 by a pair of metal supporting members or wires 30 and 31. Wire 30 and 31 are secured to ferrules 23 by welding, brazing, or other suitable attachment means. The bulb support arrangement also includes a pair of metal straps 32 and 33 which are secured around the flat base portion 26 of bulb 18. Straps 32 and 33 are each in turn cantilevered from one of the metal supporting wires 30 and 31 and are firmly secured about bulb base portion 26 so that bulb 18 is rigidly mounted in enclosure 15 with each of lead wires 27 and 28 being connected to one of the supporting wires to complete the electrical circuit between terminals 24 and filament 17 through wires 30 and 31.

As noted in the foregoing description, enclosure 15 is filled with a nonreactive or inert gas to prevent degradation of the various internal components of the lamp usually caused by moisture and other corrosive elements in the atmosphere. While helium, argon, and a number of other nonreactive gases can be used for this purpose, helium has been used in the preferred embodiment.

As shown in FIG. 1, gas filling port 34 is provided in the base or apex of reflector 12. Port 34 extends through stem 35, commonly referred to in the industry as an exhaust tubulation, integrally formed in reflector 12. Although stem 35 is shown as sealed-off in the drawings, it is initially open as shown in phantom lines at 36 in FIG. 1 during the assembly of lamp 10. This arrangement accommodates the removal of ambient air from enclosure 15 and replacing it with helium gas by injecting it through stem 35. The helium gas is injected into enclosure 15 at a pressure of approximately 10 Torrs, although it is to be understood that the invention contemplates injecting the helium at a pressure anywhere in the general range of 5 to 50 Torrs. After enclosure 15 is filled with helium and its pressure established at the perceived optimum level of 10 Torrs, stem 35 is sealed-off or plugged in the conventional manner by heating the stem and pinching it together to form a gas-tight seal.

After stem 35 is sealed-off, the invention contemplates a very quick and simple method of testing the headlamp to determine if enclosure 15 is sealed and the helium is in the desired pressure range of approximately 5 to 50 Torrs. This testing is accomplished by momentarily touching the high voltage probe of a Tesla coil to the rim of the headlamp in the proximity of adhesive 19 and observing the gas in the envelope 11. In actual testing, where the probe of a laboratory type Tesla coil such a the Model G4 manufactured by Ecco High Frequency Corporation was applied to a 7 inch rectangular sealed beam headlight, a glow discharge was consistently formed when the gas pressure in the headlamp was in the range of 5 to 50 Torrs. Alternatively, an arc discharge resulted when the gas pressure was 500 Torrs. Thus, a workman could easily determine whether a headlamp had a leak or was defectively over-pressurized by simply identifying the headlamps in which an arc discharge occurred when the probe of the Tesla coil was applied to the rim of the headlamp.

The reason for this illumination phenomena is not entirely understood. It is believed to occur because the Tesla coil typically generates a potential of several hundred thousand volts at frequencies of 1 megacycle or higher. When the pointed probe from such a coil is brought near a gas filled glass or plastic envelope containing conducting electrodes such as reflector coating 20 and burner 16, an alternating capacitive current passes through the envelope. This current may excite random electrons into an oscillating mode to ionize the gas and excite the gas atoms to their visible radiation levels. Whatever the reason, the characteristic color and shape of the visible radiation can be used as an indication of the pressure of the contained gas.

The effectiveness of this lamp construction was clearly demonstrated by testing during the development of the invention. In a test, a commercial 7 inch sealed beam headlamp was modified so the pressure of the helium in the lamp could be set at a variety of different pressures and so that the temperatures of the burner and the surface of the envelope could be measured when the lamp was turned on. The test demonstrated that when the pressure of the helium in the headlamp was in the range of 5 to 50 Torrs, heating of the burner wall was nearly 95 percent as effective as heating of the burner when the pressure of the helium in the lamp was set at 500 Torrs. More importantly, cooling of the envelope when the helium was at a pressure in the range of 5 to 50 Torrs was over 200 percent more effective than when the helium was at a pressure of 500 Torrs. This cooling effect has resulted in a design with significantly lower operating temperatures which facilitates the use of more durable and easily worked plastics which heretofore were generally difficult to use because of the higher operating temperatures of prior headlamp designs.

What is claimed is:

1. A sealed beam lamp, comprising:

an envelope having an outer shell defining a gas-tight enclosure;

an illuminating bulb having a lighting filament sealed within said bulb;

bulb support means mounted on said outer shell for securing said illuminating bulb within said gas-tight enclosure;

means for conducting electrical current coupled to said lighting filament and extending through said outer shell to selectively energize said lighting filament;

said gas-tight enclosure being filled with a relatively nonreactive gas at a pressure in the range of 5 to 50 Torrs.

2. A method of testing:

the sealed beam lamp as defined in claim 1, including electrically coupling a source of predetermined electrical potential to said envelope to create an electrical potential within said gas-tight enclosure;

whereupon, formation of a glow discharge in said non-reactive gas indicates that said gas-tight envelope is sealed and the pressure of said non-reactive gas is within the range of 5 to 50 Torrs and formation of an arc discharge indicates that the pressure of said non-reactive gas is above said range.

3. The method of claim 2, wherein said source of predetermined electrical potential is a Tesla coil.

4. A sealed beam lamp, comprising:

a gas-tight envelope having an outer shell;

a burner capsule having a bulb enclosure and a lighting filament sealed within said bulb enclosure;

a plurality of members for conducting electricity extending through said outer shell, said member for conducting electricity further including means for securing said bulb to at least one of said members for conducting electricity and for securing said bulb enclosure within said gas-tight envelope, said members for conducting electricity further being electrically coupled to said lighting filament for energizing said lighting filament; and said gas-tight envelope being filled with a relatively nonreactive gas at a pressure in the range of 5 to 50 Torrs.

5. The sealed beam lamp as defined in claim 4, wherein at least one of said members for conducting electricity includes a rigid supporting wire extending through said outer shell; and said means for securing said bulb enclosure to at least one of said members for conducting electricity and for securing said bulb enclosure within said gas-tight enclosure is a rigid strap cantilevered from said supporting wire and secured around said bulb enclosure to secure it within said gas-tight envelope.

6. The sealed beam lamp as defined in claim 4, wherein said gas-tight envelope has a concave reflector with a lip portion about its periphery and a generally disc-like lens having its periphery affixed to said lip portion.

7. The sealed beam lamp as defined in claim 6, wherein said lip portion and the periphery of said lens are affixed by an adhesive material.

8. The sealed beam lamp as defined in claim 6, wherein said reflector and said lens are formed of a plastic material.

9. The sealed beam lamp as defined in claim 6, wherein said reflector is formed of nylon and said lens is formed from a clear polycarbonate plastic.

10. The sealed beam lamp as defined in claim 9, wherein said lip portion and the periphery of said lens are affixed by an epoxy adhesive material.

11. The sealed beam lamp as defined in claim 5, wherein said bulb enclosure has a base at one end; and each of said members for conducting electricity includes a rigid supporting wire extending through said outer shell; and said means for securing said bulb enclosure within said gas-tight enclosure includes a rigid strap for each of said supporting wires, which rigid strap has one end cantilevered from its associated supporting wire and secured around said base to secure said bulb enclosure within said gas-tight enclosure.

12. The sealed beam lamp as defined in claim 4, wherein said nonreactive gas is helium.

13. The sealed beam lamp as defined in claim 4, wherein said nonreactive gas is argon.

14. The sealed beam lamp as defined in claim 4, wherein said burner capsule has a tungsten filament and a halogen gas atmosphere.

15. In a process for manufacturing a sealed beam lamp including an envelope having an outer shell which defines a gas-tight enclosure having a sealable gas filling port opening into the enclosure through the outer shell, a burner capsule having a bulb enclosure and a lighting filament sealed within the bulb enclosure, bulb enclosure support means mounted on the outer shell for securing said bulb enclosure within the gas-tight enclosure, and circuit means connected with the lighting filament and extending through the outer shell to accommodate energization of the lighting filament when the sealed beam lamp is in use, the final assembly and inspection comprising the steps of;

filling the gas-tight enclosure through the gas filling port with a relatively nonreactive gas at a pressure in the range of 5 to 50 Torrs;

closing-off the gas filling port to seal and maintain the gas within the enclosure at 5 to 50 Torrs; and creating a predetermined electrical potential within the enclosure;

whereupon, formation of a glow discharge in the gas indicates that the envelope is sealed and the gas pressure is within the range of 5 to 50 Torrs, and formation of an arc discharge indicates that the gas pressure is above 5 to 50 Torrs.

* * * * *